US012577901B2

(12) United States Patent
Takeda

(10) Patent No.: US 12,577,901 B2
(45) Date of Patent: Mar. 17, 2026

(54) WATER JACKET SPACER STRUCTURE

(71) Applicant: Mazda Motor Corporation, Aki-gun (JP)

(72) Inventor: Masafumi Takeda, Aki-gun (JP)

(73) Assignee: Mazda Motor Corporation, Aki-gun (JP)

( * ) Notice: Subject to any disclaimer, the term of this patent is extended or adjusted under 35 U.S.C. 154(b) by 14 days.

(21) Appl. No.: 18/931,773

(22) Filed: Oct. 30, 2024

(65) Prior Publication Data

US 2025/0215819 A1 Jul. 3, 2025

(30) Foreign Application Priority Data

Dec. 27, 2023 (JP) ..... 2023-220872

(51) Int. Cl.
*F01P 3/02* (2006.01)

(52) U.S. Cl.
CPC ..... *F01P 3/02* (2013.01); *F01P 2003/021* (2013.01)

(58) Field of Classification Search
CPC .. F01P 2003/028; F01P 3/02; F01P 2003/021; F02F 1/10; F02F 1/14
See application file for complete search history.

(56) References Cited

U.S. PATENT DOCUMENTS

| | | | | |
|---|---|---|---|---|
| 10,378,419 | B2 * | 8/2019 | Makino | F01P 3/02 |
| 10,995,693 | B2 | 5/2021 | Watanabe et al. | |
| 2017/0022929 | A1 * | 1/2017 | Karita | F02F 1/166 |
| 2019/0032595 | A1 * | 1/2019 | Yoshimura | F02F 1/14 |

FOREIGN PATENT DOCUMENTS

| | | | | |
|---|---|---|---|---|
| CN | 107532539 | A * | 1/2018 | F02F 1/14 |
| CN | 110300843 | A * | 10/2019 | F02F 1/40 |
| DE | 10325874 | A1 * | 5/2004 | F02F 1/14 |
| JP | 2005030297 | A * | 2/2005 | |
| JP | 2005256661 | A * | 9/2005 | |
| JP | 2008031939 | A * | 2/2008 | F02F 1/14 |
| JP | 2017198094 | A | 11/2017 | |
| KR | 20190076114 | A * | 7/2019 | F16B 47/003 |
| WO | WO-2016104478 | A1 * | 6/2016 | F02F 1/14 |
| WO | WO-2018151094 | A1 * | 8/2018 | F02F 1/004 |
| WO | WO-2020036052 | A1 * | 2/2020 | F01P 3/02 |

OTHER PUBLICATIONS

European Patent Office, Extended European Search Report Issued in Application No. 24217021.5, May 20, 2025, Germany, 7 pages.

* cited by examiner

*Primary Examiner* — George C Jin
*Assistant Examiner* — Teuta B Holbrook
(74) *Attorney, Agent, or Firm* — Alleman Hall LLP

(57) ABSTRACT

A structure of a water jacket spacer inserted into a water jacket between an outer wall surface of a cylinder bore wall of an engine and an inner wall surface of a cylinder block includes a spacer body member including upper and lower wall parts which are closer to the inner and outer wall surfaces in upper and lower parts of the water jacket, respectively, and an elongated contact member fixed at one end to the upper wall part, changeable between first and second postures where it is separated from and contacts with the outer wall surface, respectively. The contact member is in the first posture when coolant is not filled in the water jacket and the engine is not operated, and is in the second posture when the coolant is filled in the water jacket and the engine is operated.

20 Claims, 11 Drawing Sheets

WATER JACKET SPACER STRUCTURE

TECHNICAL FIELD

The present disclosure relates to a structure of a water jacket spacer inserted into a water jacket of an engine.

BACKGROUND OF THE DISCLOSURE

In water-cooled engines, a water jacket is provided on the outside of a cylinder bore wall. A water jacket spacer may be inserted into the water jacket to adjust a temperature of the cylinder bore. For example, JP2017-198094A discloses a water jacket spacer formed by combining a spacer body, a lagging material, and an elastic body.

The water jacket spacer of JP2017-198094A includes an elastic body that expands and contracts at a given temperature. This water jacket spacer is designed so that, when the elastic body contracts, its thickness dimension becomes smaller than a width dimension of the water jacket. By inserting the water jacket spacer into the water jacket while the elastic body is in the contracted state, a high degree of workability is ensured.

On the other hand, when the engine operates, a temperature of coolant inside the water jacket may exceed the given temperature. In this state, the elastic body of the water jacket spacer transitions into the expanded state. Thus, the lagging material provided on the opposite side from the elastic body with respect to the spacer body, is pressed against the cylinder bore wall. JP2017-198094A describes that, when the engine operates, having the lagging material in contact with the cylinder bore wall can reduce a temperature drop of the cylinder bore.

Incidentally, when the engine operates, the temperature of the cylinder bore is higher on a top dead center side (bore upper part) and lower on a bottom dead center side (bore lower part). For this, water jacket spacers correcting such a temperature imbalance between the bore upper part and the bore lower part have been developed. Specifically, a water jacket spacer has been developed where its space from the cylinder bore wall varies in an up-and-down direction within a cylinder axis so that a channel width of the water jacket is wider in a section surrounding the bore upper part and narrower in a section surrounding the bore lower part.

However, conventional water jacket spacers may change undesirably in the space from the cylinder bore wall due to deformation or vibration caused by the flow of the coolant. Particularly, when the channel width changes due to deformation or the vibration of the water jacket spacer in an upper part of the water jacket in the cylinder axis direction, sufficient cooling of the bore upper part may not be achieved.

SUMMARY OF THE DISCLOSURE

The present disclosure was made in view of the above situations, and aims to provide a water jacket spacer structure, which is easily inserted into a water jacket during manufacturing and capable of sufficiently cooling a bore upper part when an engine operates.

A structure of a water jacket spacer according to one aspect of the present disclosure is a structure of a water jacket spacer that is inserted into a water jacket formed between an outer wall surface of a wall of a cylinder bore of an engine and an inner wall surface of a cylinder block, the engine having a top dead center side of the cylinder bore as an upper side and a bottom dead center thereof as a lower side. The structure includes a spacer body member including an upper wall part in an upper part of the water jacket, and a lower wall part in a lower part of the water jacket, the upper wall part relatively closer to the inner wall surface and the lower wall part relatively closer to the outer wall surface, and an elongated contact member fixed at one end to the upper wall part of the spacer body member, changeable between a first posture separated from the outer wall surface and a second posture contacting the outer wall surface, and having a higher heat conductivity than the spacer body member and the wall of the cylinder bore. The contact member is in the first posture in a state where coolant is not filled in the water jacket and the engine is not operated, and is in the second posture in a state where the coolant is filled in the water jacket and the engine is operated.

In the structure of the water jacket spacer of the above-described aspect, the water jacket spacer is provided with the contact member and is configured such that the contact member takes both the first posture and the second posture. Specifically, the contact member is designed to take the first posture, where it is separated from the outer wall surface of the cylinder bore wall, for example, during the assembly of the engine where the coolant is not filled into the water jacket. Therefore, when inserting the water jacket spacer into the water jacket of the cylinder block, such as during the engine assembly, the water jacket spacer can be prevented from contacting the outer wall surface of the cylinder bore wall and the inner wall surface of the cylinder block. Thus, by adopting the structure of the water jacket spacer of the above-described aspect, high workability can be assured during the engine assembly, and deformation of or damage to the spacer body member can be prevented.

Additionally, the contact member is configured to take the second posture where it contacts the outer wall surface of the cylinder bore wall in the state where the coolant is introduced into the water jacket and the engine is operating. Therefore, after the coolant is introduced and when the engine is operating, the contact of the contact member with the outer wall surface of the cylinder bore wall prevents the spacer body member from deforming due to vibration or a temperature change of the coolant. As a result, the cooling of the coolant in the water jacket around the bore upper part is ensured. Thus, according to the structure of the water jacket spacer of this aspect, it is possible to sufficiently cool the bore upper part which reaches a high temperature during the engine operation.

Note that "in a state where the coolant is filled in the water jacket and the engine is operating" described above refers to a timing at least at which the contact member is in the second posture. Therefore, the contact member in the above-described aspect may change to the second posture when the coolant is filled, or when the coolant reaches a temperature higher than a given temperature during the engine operation.

Further, in the structure of the water jacket spacer according to the above aspect, the contact member is designed to have higher thermal conductivity than the spacer body member and the cylinder bore wall. As a result, during the engine operation, the heat from the bore upper part is transferred through the cylinder bore wall and the contact member to the coolant. Thus, according to the structure of the water jacket spacer of this aspect, the heat from the bore upper part during the engine operation can be efficiently transferred to the coolant.

Here, if the upper wall part of the spacer body member is brought into contact with the outer wall surface of the cylinder bore wall to prevent deformation of the spacer body member, the thermal conductivity becomes low due to a resin material of the spacer body member, making it difficult to cool the cylinder liner bore wall with the coolant. Consequently, by adopting such a structure, the bore upper part becomes high in temperature, degrading the engine performance (efficiency) as a result, and in the worst case, the engine may be damaged due to knocking.

In contrast, since the structure of the water jacket spacer of this aspect includes the contact member which contacts the outer wall surface of the cylinder bore wall during the engine operation, the deformation of the spacer body member due to vibration or the coolant temperature is prevented and the heat transfer from the cylinder bore wall to the coolant is performed with high heat transferability. Therefore, with the engine adopting the structure the water jacket spacer of this aspect, the thermal efficiency can be improved by advancing a knock timing, while preventing occurrence of, for example, the degradation of the engine performance (efficiency) and knocking.

The structure of the water jacket spacer of the above-described aspect may further include an expandable member changeable between a state where the expandable member is contracted to bring the contact member into the first posture, and a state where the expandable member is extended to bring the contact member into the second posture.

According to this configuration, the water jacket spacer also includes the expandable member which changes the posture of the contact member between the first and second postures. After the engine is assembled and the coolant is introduced into the water jacket, the contact member is reliably pressed against the outer wall surface of the cylinder bore wall during the engine operation. Thus, the deformation of the upper wall part of the spacer body member due to vibration during the engine operation or the coolant temperature is prevented. Therefore, the engine adopting the structure of the water jacket spacer of this aspect can improve the thermal efficiency by advancing a knock timing, and is suitable for preventing occurrence of, for example, the degradation of the engine performance (efficiency) and knocking.

In the structure of the water jacket spacer of the above-described aspect, the expandable member may be formed using one of cellulose sponge and bimetal.

According to this configuration, since the expandable member may be formed by using cellulose sponge or bimetal, the contact member can be changed between the first and second postures. When the expandable member is formed by using cellulose sponge, during the engine assembly where the cellulose sponge is not immersed in the coolant, the expandable member is in the contracted state, and the contact member cannot be pressed against the cylinder bore wall. Thus, a gap can be created between the water jacket spacer and the wall surfaces surrounding the water jacket (the outer wall surface of the cylinder bore wall and the inner wall surface of the cylinder block), and high workability can be assured during the engine assembly, for example. After the engine assembly, filling of the coolant brings the expandable member to the extended state to act on the contact member so that the contact member takes the second posture. Therefore, the bore upper part can be effectively cooled during the engine operation.

On the other hand, when the expandable member is formed by using a bimetal, during the engine assembly, the environmental temperature is a normal temperature, and the expandable member is in the contracted state. Thus, high workability can be assured similarly to the case where cellulose sponge is used for the expandable member as described above. During the engine operation, when the coolant temperature becomes the given temperature or above, the expandable member acts on the contact member so that it takes the second posture. Therefore, the bore upper part can be effectively cooled during the engine operation.

Note that the above-described given temperature refers to a lower limit temperature at which the engine is in a warm state. Specifically, it may be a temperature of approximately 90° C.

In the structure of the water jacket spacer of the above-described aspect, the spacer body member may include a connecting wall part connecting the upper wall part with the lower wall part. The connecting wall part may be formed with a through hole through which the contact member is inserted, and the expandable member may be disposed below the connecting wall part.

According to this configuration, since the expandable member is positioned lower than the connecting wall part, a flow of the coolant above the connecting wall part is not interrupted by the expandable member during the engine operation. Thus, in the structure of the water jacket spacer of this aspect, the bore upper part can be effectively cooled during the engine operation.

In the structure of the water jacket spacer of the above-described aspect, the spacer body member may include a connecting wall part connecting the upper wall part with the lower wall part, and the expandable member may be disposed on or above the connecting wall part.

According to this configuration, since the expandable member is disposed on the connecting wall part or above, there is no need to form a hole in the connecting wall part, which allows the insertion of the contact member. Consequently, during the operation of the engine, a flow of the coolant is separated to above and below the connecting wall part to prevent the coolant from being disturbed. Therefore, by adopting the structure of the water jacket spacer of this aspect, the bore upper part can effectively be cooled during the operation of the engine.

Furthermore, with this structure of the water jacket spacer, the expandable member is disposed in the channel of the coolant above the connecting wall part. Therefore, the channel becomes narrower in the water jacket above the connecting wall part, due to the disposition of the expandable member. In the section where the channel is narrower, the coolant flow speed increases, which is suitable for releasing heat from the bore upper part to the coolant. In other words, the flow speed of the coolant flowing in contact with the outer wall surface of the cylinder bore wall increases, and the cooling efficiency through the outer wall surface of the cylinder bore wall is less likely to decrease even when the expandable member is disposed. Further, the contact area with the coolant increases by the contact member which is in contact with the outer wall surface of the cylinder bore wall, resulting in improved cooling of the bore upper part according to the increased contact area.

In the structure of the water jacket spacer of the above-described aspect, the spacer body member may be formed using a resin material, and the contact member may be formed using a metal material.

According to this configuration, the contact member is formed by using a metal material, and has higher thermal conductivity than the spacer body member which is formed by using a resin material. Thus, during the engine operation, by the contact member being pressed against the outer wall surface of the cylinder bore wall, heat generated in the bore upper part can effectively be released to the coolant.

In the structure of the water jacket spacer of the above-described aspect, the contact member may change between the first posture and the second posture within an elastic range.

According to this configuration, since the contact member is configured to change from the first posture to the second posture within its elastic range, it can be removed from the water jacket and then reinserted thereinto not only during the engine assembly, but also during the engine maintenance. Thus, by adopting the structure of the water jacket spacer of this aspect, the spacer can be reused after the maintenance, not only during the engine assembly, reducing maintenance costs.

In the structure of the water jacket spacer of the above-described aspect, the contact member may be formed using a shape-memory alloy, and configured to be in the first posture when a temperature of the contact member is below a given temperature, and the second posture when the temperature of the contact member is the given temperature or above in association with a temperature rise of the coolant.

According to this configuration, since the contact member is formed by using the shape-memory alloy, it changes posture depending on its temperature. In other words, for example, during the engine assembly, the environmental temperature is a normal temperature, and thus, the contact member also has a normal temperature (below the given temperature) and takes the first posture. Therefore, high workability can be assured during the engine assembly. During the engine operation, when the coolant temperature becomes the given temperature or above, the contact member also becomes the given temperature or above, and takes the second posture. Therefore, the bore upper part can be effectively cooled during the engine operation.

In the structure of the water jacket spacer of the above-described aspect, the contact member may be one of a plurality of contact members arranged in a wall of a single cylinder bore to be away from each other in a circumferential direction of the cylinder bore.

According to this configuration, a plurality of contact members are distributed circumferentially for a single cylinder bore wall. It makes possible to distribute circumferentially a plurality of contacting positions of the contact members with the outer wall surface of the cylinder bore wall. Thus, heat from the bore upper part can be released to the coolant while reducing variation in the circumferential direction. Therefore, by adopting the structure of the water jacket spacer of this aspect, the bore upper part can effectively be cooled while reducing variation in the circumferential direction.

In the structure of the water jacket spacer of the above-described aspect, the engine may be an inline multi-cylinder engine formed with a plurality of cylinder bores arranged in a cylinder-row direction, and the contact member may be disposed to be contactable in a part of the outer wall surface of the cylinder bore wall between adjacent cylinder bores.

According to this configuration, since the contact member is arranged to be able to contact a part of the outer wall surface of the cylinder bore wall between adjacent cylinder bores, the bore upper part can effectively be cooled through the cylinder bore wall. This is because the part of the outer wall surface of the cylinder bore wall between adjacent cylinder bores becomes higher in temperature than other parts of the cylinder bore wall during the engine operation, and contacting the contact member made from a metal material with the higher-temperature part makes it possible to release the heat to the coolant through the contact member.

DETAILED DESCRIPTION OF THE DISCLOSURE

Figure 1:
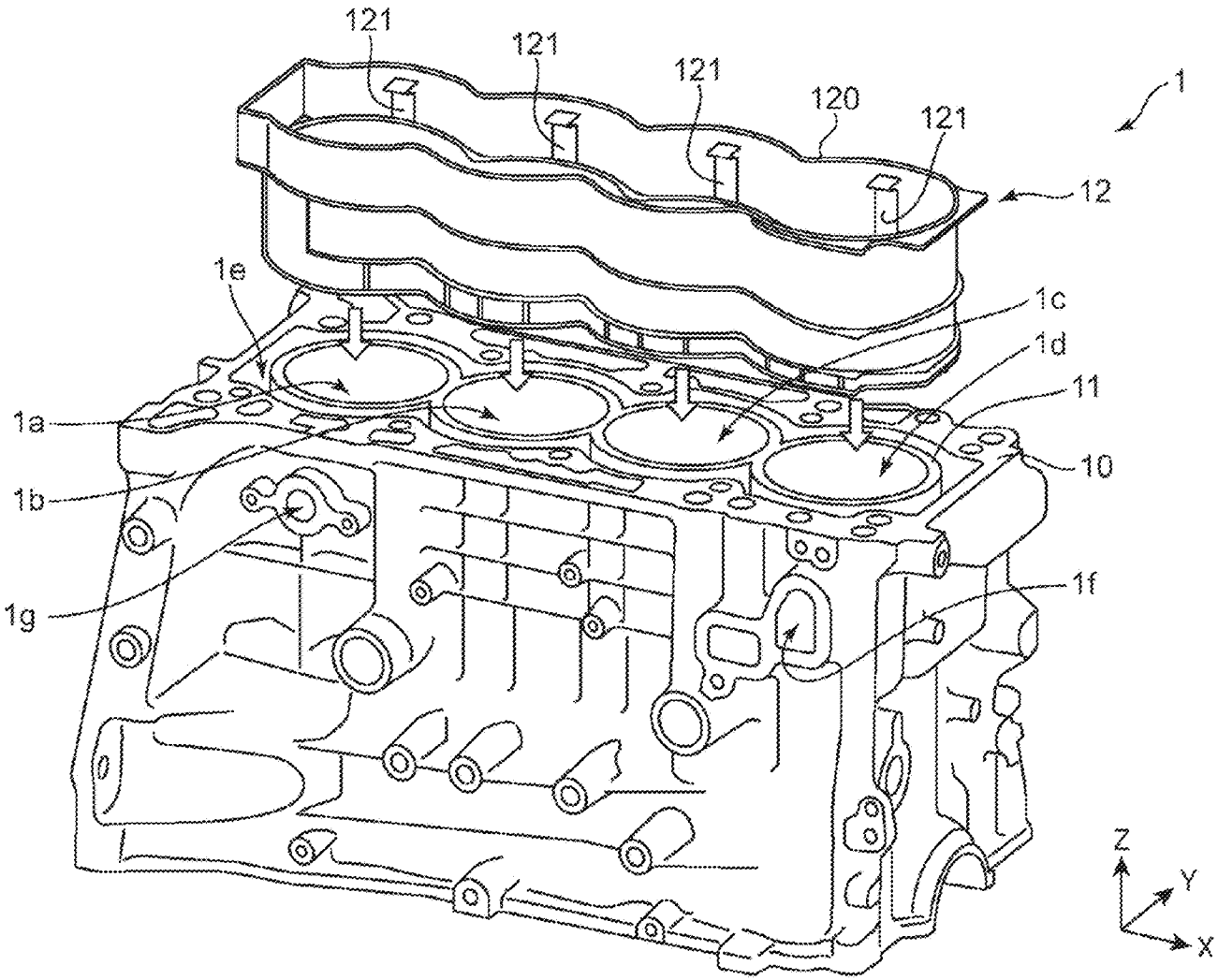
FIG. 1 is an exploded perspective view illustrating a partial structure of an engine to which a water jacket spacer according to a first embodiment of the present disclosure is applied.

Hereinafter, some embodiments of the present disclosure will be described with reference to the accompanying drawings. Note that the embodiments described below are merely illustration of the present disclosure, and the present disclosure is not limited to these embodiments, except for its essential configuration.

In the drawings used in the following description, "X" indicates a cylinder row direction of an engine, "Y" indicates an intake-and-exhaust direction of the engine, and "Z" indicates a cylinder axis direction of the engine. In the following description, a side of the cylinder axis direction corresponding to a top dead center is referred to as "up" or "upper," and a side of the cylinder axis direction corresponding to a bottom dead center as "down" or "lower."

First Embodiment

1. Structure of Engine 1

A structure of an engine 1 provided with a water jacket spacer 12 according to a first embodiment will be explained with reference to FIG. 1. Note that FIG. 1 only illustrates a portion of the engine 1.

As illustrated in FIG. 1, the engine 1 has four cylinder bores 1*a* to 1*d* arranged in the X direction. That is, the engine 1 is an inline four-cylinder engine. However, the type of the engine and the number of cylinders thereof are not limited to this.

A cylinder block 10 of the engine 1 contains a cylinder liner 11 fitted to surround the cylinder bores 1*a* to 1*d*. The cylinder liner 11 forms walls of the cylinder bores, and a surface thereof opposite from the cylinder bores 1*a* to 1*d* (inner wall surfaces of the cylinder liner 11) serves as an outer wall surface of the cylinder bore walls.

The cylinder block 10 is provided with a water jacket 1*e* formed facing an outer wall surface of the cylinder liner 11. The water jacket 1*e* is a passage through which coolant introduced from a coolant inlet 1*f* circulates. The cylinder block 10 may also be provided with a coolant outlet 1*g* from which a portion of the coolant flowing through the water jacket 1*e* is discharged. Note that the remaining portion of the coolant from the water jacket 1*e* is discharged to a cylinder head which is omitted from the illustration.

A water jacket spacer 12 is inserted into the water jacket 1*e*. The water jacket spacer 12 is inserted into the water jacket 1*e* before the coolant is introduced into the water jacket 1*e*. Note that in a state where the water jacker spacer 12 is inserted into the water jacket 1*e*, a lower end of the water jacket spacer 12 in the Z direction is either in contact with or in close proximity to a bottom of the water jacket 1*e*.

The water jacket spacer 12 includes a spacer body member 120 formed by using a resin material (e.g., PTFE, PPS, or PA), and contact members 121 fixed near an upper end of an inner surface of the spacer body member 120 and formed by using a metal material (e.g., steel plate or copper alloy).

2. Arrangement of Contact Members 121 in Water Jacket Spacer 12

An arrangement of the contact members 121 in the water jacket spacer 12 will be described with reference to FIG. 2.

Figure 2:
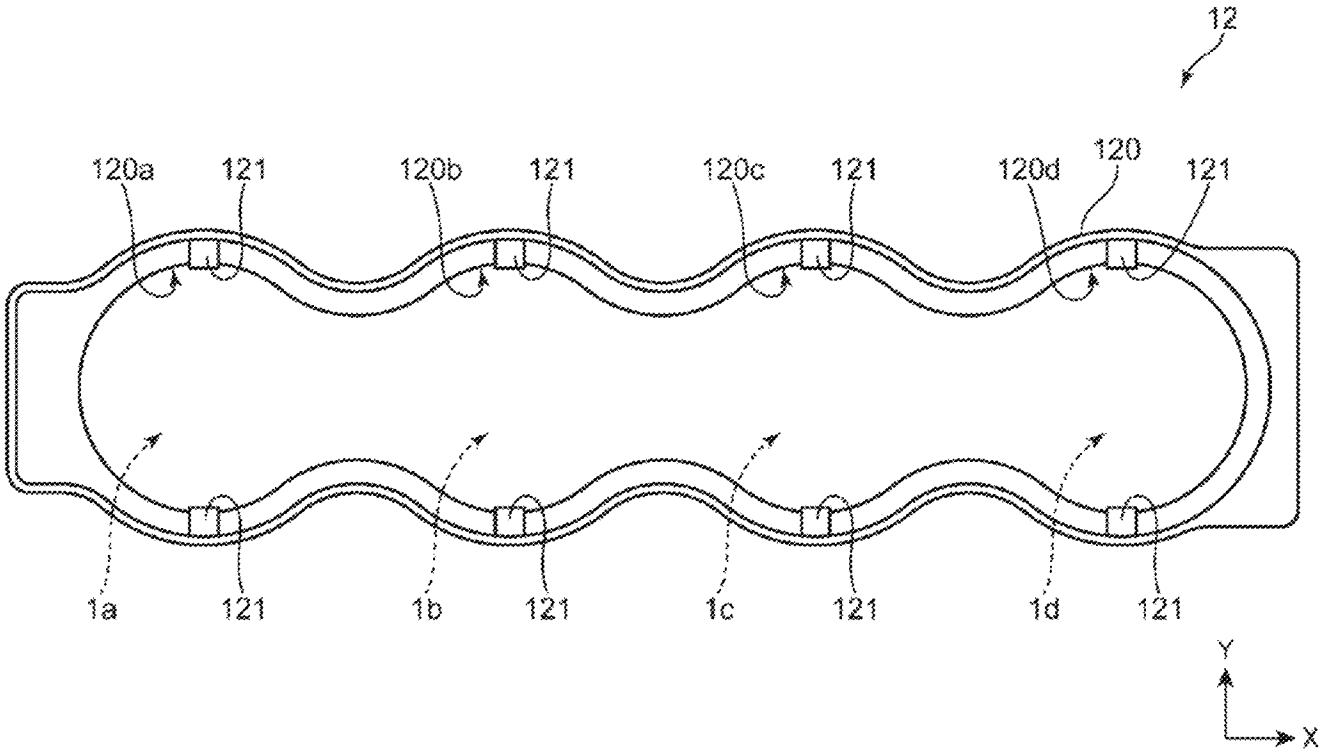
FIG. 2 is a plan view illustrating a structure of the water jacket spacer.

As illustrated in FIG. 2, the spacer body member 120 has bore surrounding parts 120*a* to 120*d* surrounding the cylinder bores 1*a* to 1*d*, respectively, when seen in the cylinder axis direction. The bore surrounding parts 120*a* to 120*d* are integrally formed in a continuous manner.

Each of the bore surrounding parts 120*a* and 120*d* is provided with two contact members 121 arranged away from each other. The contact members 121 arranged in each of the bore surrounding part 120*a* to 120*d* are positioned opposite from each other in the Y direction (intake-and-exhaust direction).

3. Structures of Contact Members 121 and Surrounding Components

Figure 3:
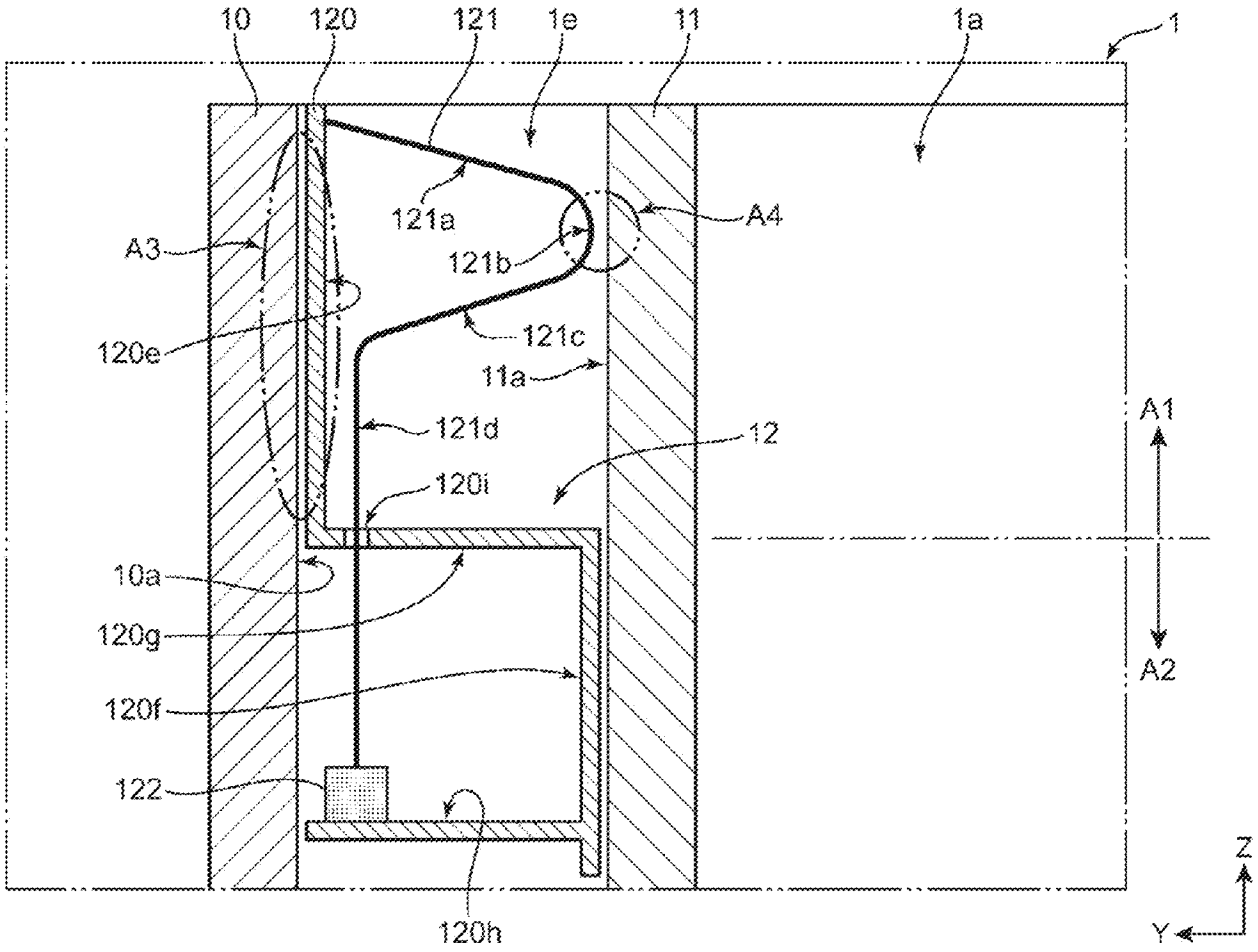
FIG. 3 is a cross-sectional view illustrating the structure of the water jacket spacer.

The structures of each contact member 121 and its surrounding components in the water jacket spacer 12 will be described with reference to FIGS. 3 and 4. FIG. 3 illustrates a state before the coolant is introduced into the water jacket 1*e*, while FIG. 4 illustrates a state after the coolant is introduced into the water jacket 1*e*.

Figure 4:
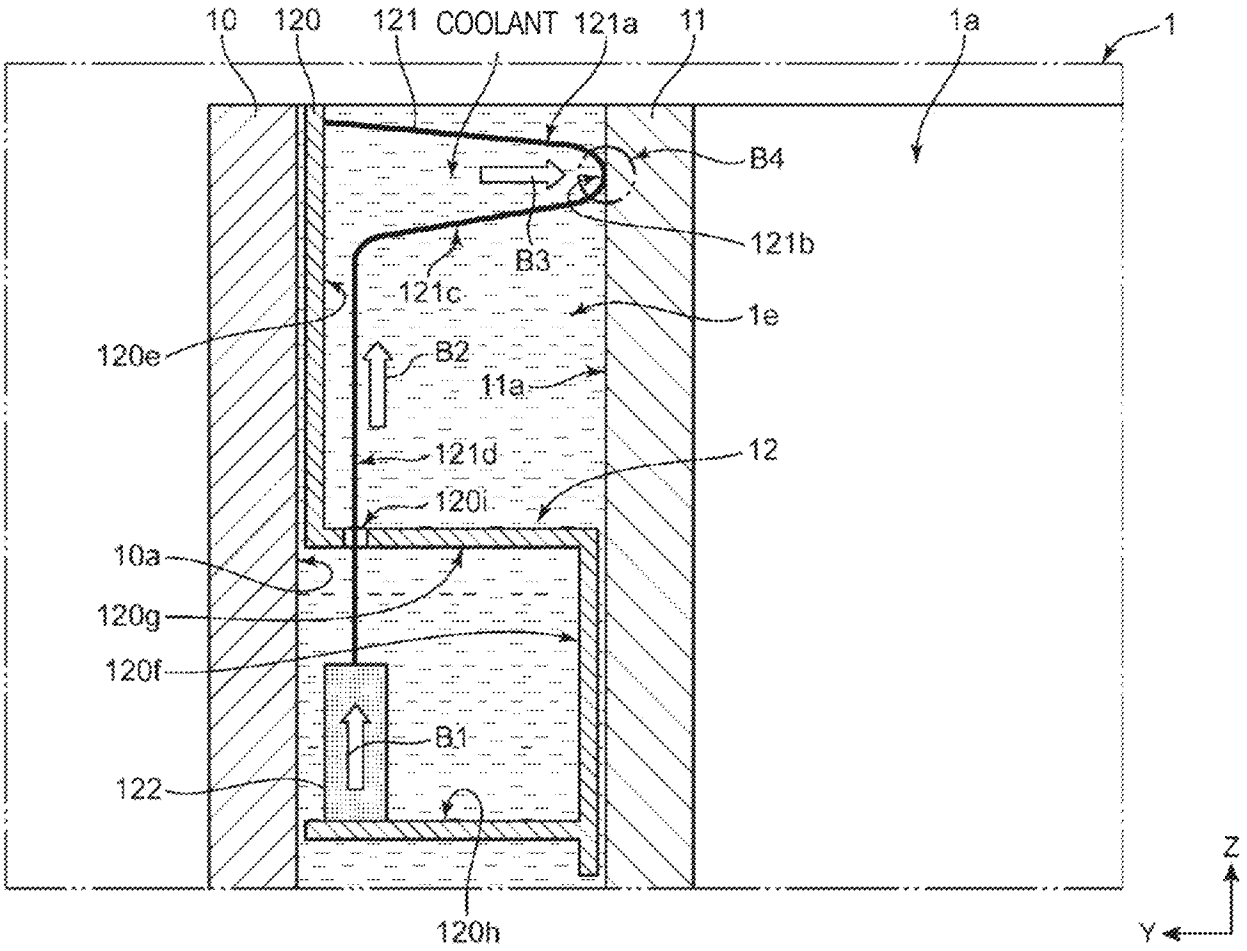
FIG. 4 is a cross-sectional view illustrating a state of the water jacket spacer where coolant is filled in a water jacket.

As illustrated in FIGS. 3 and 4, the spacer body member 120 is integrally formed with an upper wall part 120*e*, a lower wall part 120*f*, a connecting wall part 120*g*, and a bottom wall part 120*h*. The upper wall part 120*e* extends along an inner wall surface 10*a* of the cylinder block 10 facing the water jacket 1*e*. The lower wall part 120*f* is positioned below the upper wall part 120*e* in the Z direction (cylinder axis direction) and extends along an outer wall surface 11*a* of the cylinder liner 11 facing the water jacket 1*e*.

The connecting wall part 120*g* extends perpendicular to the Z direction (cylinder axis direction) and connects a lower end portion of the upper wall part 120*e* with an upper end portion of the lower wall part 120*f*. Note that the connecting wall part 120*g* is formed with a through hole 120*i* in its thickness direction. The bottom wall part 120*h* extends perpendicular to the Z direction (cylinder axis direction) from near a lower end portion of the lower wall part 120*f*.

Here, the position where the connecting wall part 120*g* is provided in the Z direction (height direction of the water jacker spacer 12) is set as a boundary between a bore upper part A1 and a bore lower part A2 of each of the cylinder bores 1*a* to 1*d*. This boundary position has been experimentally determined in advance regarding a portion reaching a given temperature or above during operation of the engine 1 and a portion maintaining below the given temperature.

The contact member 121 is a long plate having a given width (for example, about 5 mm to 20 mm) in a direction perpendicular to the plane of FIGS. 3 and 4. The contact member 121 is integrally formed with an upper extending part 121*a*, a curving part 121*b*, a lower extending part 121*c*, and a longitudinal extending part 121*d*. The upper extending part 121*a* is fixed at one end to near an upper end portion of the upper wall part 120*e* of the spacer body member 120. The upper extending part 121*a* extends inward in the Y direction (intake-and-exhaust direction) from its end fixed to the spacer body member 120. The upper extending part 121*a* is slanted downward in the Z direction from the one end while extending inward in the Y direction.

The curving part 121*b* is connected at one end to the other end (inner end in the Y direction) of the upper extending part 121*a* and forms approximately 180° of arc-like shape. The lower extending part 121*c* is connected at one end to the other end (lower end in the Z direction) of the curving part 121*b* and extends outward therefrom in the Y direction (toward the inner wall surface 10*a* of the cylinder block 10). The lower extending part 121*c* is slanted downward in the Z direction from the one end while extending outward in the Y direction.

When seen from sideways, the upper extending part 121*a*, the curving part 121*b*, and the lower extending part 121*c* as a whole form a V-like shape.

The longitudinal extending part 121*d* is connected at its upper end to the other end (outer end in the Y direction) of the lower extending part 121*c* and extends downward. An intermediate portion of the longitudinal extending part 121*d* in its extending direction passes through the hole 120*i* in the connecting wall part 120*g* of the spacer body member 120. The longitudinal extending part 121*d* extends to reach slightly above the bottom wall part 120*h*.

In addition to the spacer body member 120 and the contact member 121, the water jacket spacer 12 of this embodiment also includes an expandable member 122. The expandable member 122 is a material which expands when immersed in the coolant, and in this embodiment, is formed by using cellulose sponge as an example. The expandable member 122 is fixed to an upper side of the bottom wall part 120*h* of the spacer body member 120, and a lower end of the longitudinal extending part 121*d* is joined to an upper part of the expandable member 122.

When the expandable member 122 is not immersed in the coolant, such as during assembly of the engine 1, the expandable member 122 is in a contracted state in the Z direction. Therefore, the longitudinal extending part 121*d* of the contact member 121 is entirely pulled downward in the Z direction, and the other end of the lower extending part 121*c* (the connecting portion with the longitudinal extending part 121*d*) is also positioned lower in the Z direction. As a result, the V-like portion formed by the upper extending part

121*a*, the curving part 121*b*, and the lower extending part 121*c* opens outwardly in the Y direction.

That is, when the expandable member 122 is not immersed in the coolant during the assembly of the engine 1, a space between an outer wall surface of the upper wall part 120*e* of the spacer body member 120 (the surface facing the inner wall surface 10*a* of the cylinder block 10) and a nearest position of the curving part 121*b* of the contact member 121 to the outer surface 11*a* of the cylinder liner 11 is narrower than the space of the water jacket 1*e*. Therefore, when inserting the water jacket spacer 12 into the water jacket 1*e*, the water jacket spacer 12 creates a gap from both the inner wall surface 10*a* of the cylinder block 10 and the outer wall surface 11*a* of the cylinder liner 11 (arrows A3 and A4). The posture of the contact member 121 illustrated in FIG. 3 is a first posture.

On the other hand, as illustrated in FIG. 4, after the assembly of the engine 1 is completed and the coolant is introduced into the water jacket 1*e*, the expandable member 122 is immersed in the coolant and expands as indicated by an arrow B1. As a result, the longitudinal extending part 121*d* of the contact member 121 is pushed upward in the Z direction, as indicated by an arrow B2. Thus, the opening of the V-like portion of the contact member 121 on the outer side in the Y direction has a narrower width.

By the deformation of the contact member 121 as described above, the curving part 121*b* of the contact member 121 is pressed against the outer wall surface 11*a* of the cylinder liner 11, as indicated by an arrow B3 and a location B4. Note that depending on the material selected for the contact member 121, the pressing force against the outer wall surface 11*a* of the cylinder liner 11 may be large. In this case, a reaction force may be created from the pressing force, causing the upper wall part 120*e* of the spacer body member 120 to be closer to or contact the inner wall surface 10*a* of the cylinder block 10. The posture of the contact member 121 illustrated in FIG. 4 is a second posture.

However, from a perspective of cooling the bore upper part A1, it is preferable that the upper wall part 120*e* of the spacer body member 120 does not move toward the inner wall surface 10*a* of the cylinder block 10, even when the posture of the contact member 121 changes from the first posture to the second posture. By preventing the upper wall part 120*e* of the spacer body member 120 from moving toward the inner wall surface 10*a* of the cylinder block 10, it can be suppressed that a channel width between the outer wall surface 11*a* of the cylinder liner 11 and the upper wall part 120*e* of the spacer body member 120 in the water jacket 1*e* is expanded and that a flow speed of the coolant is reduced. As a result, the flow speed reduction of the coolant in the upper part of the water jacket 1*e* can be suppressed, and the contact area of the contact member 121 with the outer wall surface 11*a* of the cylinder liner 11 increases, which is advantageous in cooling the bore upper part A1.

Here, in the water jacket spacer 12 of this embodiment, the contact member 121 can transition between the state illustrated in FIG. 3 and the state illustrated in FIG. 4 within its elastic range. Therefore, when removing the water jacket spacer 12 from the water jacket 1*e* for, for example, maintenance, the coolant can be drained from the water jacket 1*e* to bring the expandable member 122 into the state illustrated in FIG. 3, where the expandable member 122 is not immersed in the coolant. Thus, high workability can be assured and the deformation of or the damage to the spacer body member 120 can be prevented during the removal.

4. Effect(s)

In the water jacket spacer 12 of this embodiment, the water jacket spacer 12 is provided with the contact member 121 and is configured such that the contact member 121 takes both the first posture (illustrated in FIG. 3) and the second posture (illustrated in FIG. 4). As described above, the contact member 121 is designed to take the first posture, where it is separated from the outer wall surface 11*a* of the cylinder liner (cylinder bore wall) 11, for example, during the assembly of the engine 1 where the coolant is not introduced into the water jacket 1*e*. Therefore, when inserting the water jacket spacer 12 into the water jacket 1*e*, such as during the engine assembly, the water jacket spacer 12 is prevented from contacting the outer wall surface 11*a* of the cylinder liner 11 and the inner wall surface 10*a* of the cylinder block 10. Thus, high workability can be assured during the engine assembly, and the deformation of or the damage to the spacer body member 120 can be prevented.

Additionally, as illustrated in FIG. 4, the contact member 121 is configured to take the second posture where it contacts the outer wall surface 11*a* of the cylinder liner 11 in the state where the coolant is introduced into the water jacket 1*e*. Therefore, after the coolant is introduced and when the engine 1 operates, the contact of the contact member 121 with the outer wall surface 11*a* of the cylinder liner 11 prevents the upper wall part 120*e* of the spacer body member 120 from deforming due to vibrations from the engine operation or an effect of a temperature change of the coolant. As a result, the cooling of the coolant in the water jacket 1*e* around the bore upper part A1 is ensured. Thus, by adopting the structure of the water jacket spacer 12 of this embodiment, it is possible to sufficiently cool the bore upper part A1, which reaches a high temperature during the engine operation.

Furthermore, in the water jacket spacer 12 of this embodiment, the contact member 121 is designed to have higher thermal conductivity than the spacer body member 120 and the cylinder liner 11. Specifically, in this embodiment, the spacer body member 120 is formed by using a resin material (e.g., PTFE, PPS, or PA), while the contact member 121 is formed by using a metal material (e.g., steel plate or copper alloy). As a result, during the engine operation, the contact member 121 takes the second posture where it contacts (is pressed against) the outer wall surface 11*a* of the cylinder liner 11, allowing the heat from the bore upper part A1 to be transferred through the cylinder liner 11 and the contact member 121 to the coolant in the water jacket 1*e*. Thus, by adopting the water jacket spacer 12 of this embodiment, the heat from the bore upper part A1 during the engine operation can be efficiently transferred to the coolant.

Here, if the upper wall part 120*e* of the spacer body member 120 is brought into contact with the outer wall surface 11*a* of the cylinder liner 11 to prevent deformation of the spacer body member 120, the thermal conductivity becomes low due to the resin material of the spacer body member 120, making it difficult to cool the cylinder liner 11 with the coolant. Consequently, by adopting such a structure, the bore upper part A1 becomes high in temperature, degrading the engine performance (efficiency) as a result, and in the worst case, the engine may be damaged due to knocking.

In contrast, since the structure of the water jacket spacer 12 of this embodiment includes the contact member 121 which contacts the outer wall surface 11*a* of the cylinder liner 11 during the engine operation, the deformation of the spacer body member 120 due to vibrations or the coolant temperature is prevented and the heat transfer from the cylinder liner 11 to the coolant is performed with high heat transferability. Therefore, with the engine 1 adopting the structure the water jacket spacer 12 of this embodiment, the thermal efficiency can be improved by advancing a knock timing, while preventing occurrence of, for example, the degradation of the engine performance (efficiency) and knocking.

The water jacket spacer 12 of this embodiment also includes the expandable member 122 which changes the posture of the contact member 121 between the first and second postures. After the engine 1 is assembled and the coolant is introduced into the water jacket 1*e*, the contact member 121 is reliably pressed against the outer wall surface 11*a* of the cylinder liner 11 during the engine operation. Thus, the deformation of the upper wall part 120*e* of the spacer body member 120 due to vibrations during the engine operation or the coolant temperature is prevented. Therefore, the engine 1 adopting the structure of the water jacket spacer 12 of this embodiment is suitable for preventing occurrence of, for example, the degradation of the engine performance (efficiency) and knocking.

In this embodiment, the expandable member 122 is formed by using cellulose sponge. Therefore, the contact member 121 can be changed between the first and second postures without using a complex or expensive component.

Additionally, in the water jacket spacer 12 of this embodiment, the expandable member 122 is positioned lower than the connecting wall part 120*g* of the spacer body member 120. Therefore, the flow of the coolant above the connecting wall part 120*g* is not interrupted by the expandable member 122 during the engine operation. Thus, by adopting the water jacket spacer 12 of this embodiment, the bore upper part A1 can be effectively cooled during the engine operation.

In the water jacket spacer 12 of this embodiment, as illustrated in FIG. 2, two contact members 121 are distributed circumferentially (oppositely positioned in the plan view) for each of the cylinder bore 1*a* to 1*d*. This arrangement prevents the upper wall part 120*e* of the spacer body member 120 from partially deforming in its circumferential direction due to vibrations from the engine or the effect of the coolant temperature, and the heat transfer from the outer wall surface 11*a* of the cylinder liner 11 and the contact member 121 to the coolant can effectively be performed. Therefore, by adopting the water jacket spacer 12 of this embodiment, the bore upper part A1 can effectively be cooled.

Since the contact member 121 of this embodiment is configured to change from the first posture to the second posture within its elastic range, it can be removed from the water jacket 1*e* and then reinserted thereinto not only during the engine assembly, but also during the engine maintenance. Thus, by adopting the water jacket spacer 12 of this embodiment, the spacer can be reused after the maintenance, not only during the engine assembly, reducing maintenance costs.

As described above, by adopting the structure of the water jacket spacer 12 of this embodiment, it is easy to insert the water jacket spacer 12 into the water jacket 1*e* in the manufacturing stage, and the bore upper part A1 can sufficiently be cooled during the engine operation.

Second Embodiment

Figure 5:
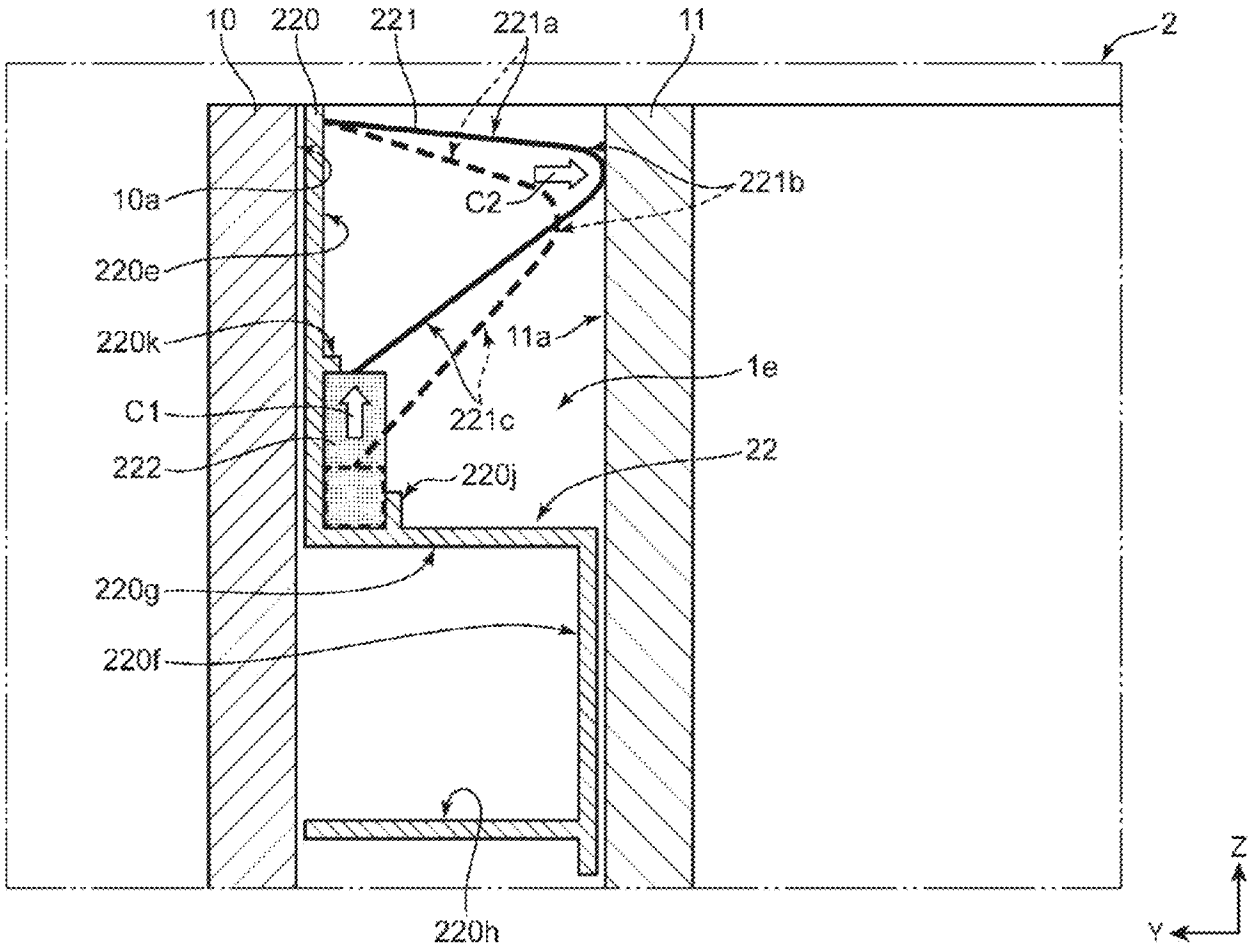
FIG. 5 is a cross-sectional view illustrating a structure of a water jacket spacer according to a second embodiment of the present disclosure.

A structure of a water jacket spacer 22 according to a second embodiment will be explained with reference to FIG. 5. FIG. 5 is a cross-sectional view illustrating a partial structure of an engine 2 to which the water jacket spacer 22 is adopted. In FIG. 5, the same reference alphanumeric symbols are used for the same components as those in the first embodiment, and their explanations are omitted below.

In the water jacket spacer 22 of this embodiment, a fixed position of an expandable member 222 relative to a spacer body member 220 is different from that of the first embodiment.

As illustrated in FIG. 5, also in the water jacket spacer 22 of this embodiment, the spacer body member 220 is formed by using a resin material, and an upper wall part 220*e*, a lower wall part 220*f*, a connecting wall part 220*g*, and a bottom wall part 220*h* are integrally formed. However, in this embodiment, the spacer body member 220 is not formed with a hole in the connecting wall part 220*g*, and additionally, a restriction wall part 220*k* connected to the upper wall part 220*e*, and a restriction wall part 220*j* connected to an upper surface of the connecting wall part 220*g* are also integrally formed.

In the water jacket spacer 22, the expandable member 222 is disposed between the upper wall part 220*e* and the restriction wall part 220*j*. Similarly to the first embodiment, the expandable member 222 is, for example, formed by using cellulose sponge, and expands when immersed in coolant as illustrated by an arrow C1. The upper expansion of the expandable member 222 is restricted by the restriction wall part 220*k*.

A contact member 221 of this embodiment is also formed by using a metal material (e.g., steel plate or copper alloy), similarly to the first embodiment. The contact member 221 of this embodiment is integrally formed with an upper extending part 221*a*, a curving part 221*b*, and a lower extending part 221*c*, but unlike the first embodiment, it does not include a longitudinal extending part. In other words, in this embodiment, a lower end of the lower extending part 221*c* of the contact member 221 is directly joined to the expandable member 222.

One end portion of the lower extending part 221*c* of the contact member 221 is connected to the curving part 221*b*, and the other end portion of the lower extending part 221*c* of the contact member 221 is fixed to an upper surface of the expandable member 222. Also in the water jacket spacer 22 of this embodiment, the expandable member 222 formed by using cellulose sponge expands (extends) as indicated by the arrow C1 when immersed in the coolant. Therefore, the other end portion of the lower extending part 221*c* (opposite from the end portion connected to the curving part 221*b*) is lifted upward in the Z direction and, as a result, the contact member 221 changes its posture from a first posture (indicated by a dashed line) to a second posture (indicated by a solid line). When the contact member 221 changes to the second posture, similarly to the first embodiment, the curving part 221*b* of the contact member 221 is pressed against the outer wall surface 11*a* of the cylinder liner 11, as indicated by an arrow C2.

Although this embodiment of the water jacket spacer 22 is different from the first embodiment in the aspects mentioned above, it can achieve the same effects as the first embodiment.

Moreover, in the water jacket spacer 22 of this embodiment, since the expandable member 222 is disposed on the connecting wall part 220*g* of the spacer body member 220, there is no need to form the hole 121*i* (see FIGS. 3 and 4) in the connecting wall part 120*g*, which allows the insertion of the longitudinal extending part 121*d* of the contact member 121, as in the first embodiment. Consequently, during operation of the engine 2, a flow of the coolant is separated to above and below the connecting wall part 220*g* to prevent the coolant from mixing therebetween, and the flow of the coolant within the water jacket 1*e* above the connecting wall part 220*g* is less likely to be interrupted. Therefore, by adopting the water jacket spacer 22 of this embodiment, the bore upper part A1 (see FIG. 3) can effectively be cooled during the operation of the engine 2.

Furthermore, with the structure of the water jacket spacer 22 according to this embodiment, the expandable member 222 is disposed in the water jacket 1*e* above the connecting wall part 220*g*. Therefore, the channel becomes narrower in the water jacket 1*e* above the connecting wall part 220*g*, due to the disposition of the expandable member 222. In the section where the channel is narrower, the coolant flow speed increases, which is suitable for releasing heat from the bore upper part A1 (see FIG. 3) to the coolant. In other words, the contact area with the coolant increases by the contact member 221 which is in contact with the outer wall surface 11*a* of the cylinder liner 11, resulting in improved cooling of the bore upper part A1 according to the increased contact area.

In this embodiment, the restriction wall part 220*j* is provided to the connecting wall part 220*g* to restrict the expandable member 222, and the restriction wall part 220*k* is provided to the upper wall part 220*e* to restrict the upper limit position of the expandable member 222 when it expands. However, these restriction wall parts 220*j* and 220*k* are not essential components.

Third Embodiment

Figure 6:
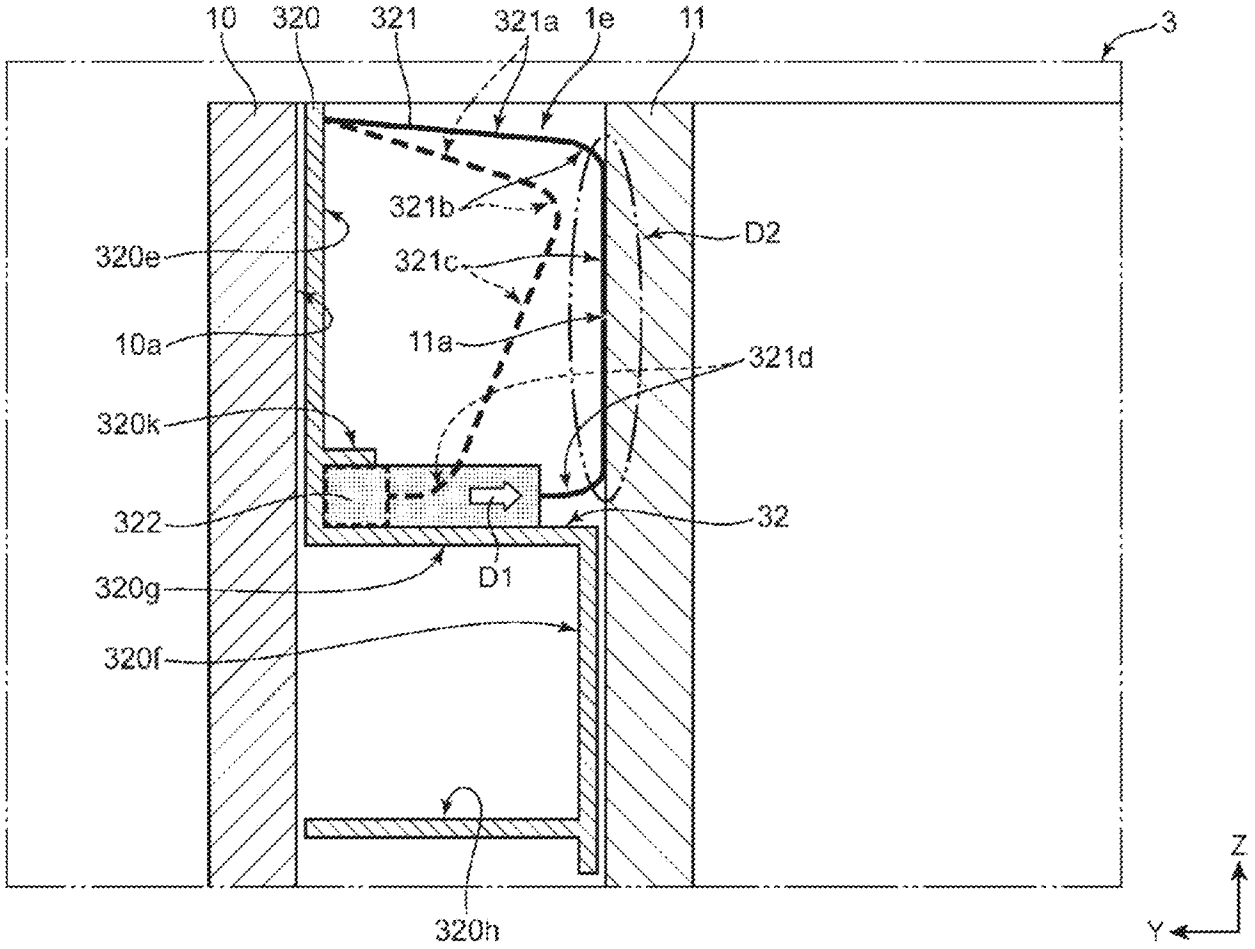
FIG. 6 is a cross-sectional view illustrating a structure of a water jacket spacer according to a third embodiment of the present disclosure.

A structure of a water jacket spacer 32 according to a third embodiment will be explained with reference to FIG. 6. FIG. 6 is a cross-sectional view illustrating a partial structure of an engine 3 to which the water jacket spacer 32 is applied. In FIG. 6, the same reference alphanumeric symbols are used for the same components as those in the first embodiment, and their explanations are omitted below.

In the water jacket spacer 32 of this embodiment, the expanding direction of an expandable member 322 is different from that of the second embodiment.

As illustrated in FIG. 6, also in the water jacket spacer 32 of this embodiment, a spacer body member 320 is formed by using a resin material and is formed integrally with an upper wall part 320*e*, a lower wall part 320*f*, a connecting wall part 320*g*, and a bottom wall part 320*h*. Additionally, the spacer body member 320 of this embodiment is integrally formed with a restriction wall part 320*k* connected to the upper wall part 320*e*.

In the water jacket spacer 32, the expandable member 322 is disposed between the connecting wall part 320*g* and the restriction wall part 320*k* and is arranged such that its direction of higher expansion is in the Y direction. Note that similarly to the first and second embodiments, the expandable member 322 is formed by using, for example, cellulose sponge, and expands (extends) toward the cylinder liner 11 as indicated by an arrow D1 when immersed in coolant.

Similarly to the first and second embodiments, a contact member 321 is formed by using a metal material (e.g., steel plate or copper alloy). The contact member 321 of this embodiment is integrally formed with an upper extending part 321*a*, a curving part 321*b*, a longitudinal extending part 321*c*, and a curving part 321*d*. The longitudinal extending part 321*d* extends in a substantially straight line to connect the curving part 321*b* with the curving part 321*d*. One end of the curving part 321*d* is connected to the longitudinal extending part 321*c* and the opposite end thereof is fixed to an inner side surface of the expandable member 322 in the Y direction.

Also in the water jacket spacer 32 of this embodiment, the expandable member 322 formed by using cellulose sponge expands (extends) as indicated by the arrow D1 when immersed in the coolant. Therefore, the curving part 321*d* of the contact member 321 fixed to the inner side surface of the expandable member 322 in the Y direction moves inward in the Y direction (radially inward). As a result, the contact member 321 changes its posture from a first posture (indicated by the dashed line) to a second posture (indicated by the solid line). When the contact member 321 changes to the second posture, the longitudinal extending part 321*c* between the curving parts 321*b* and 321*d* is pressed against the outer wall surface 11*a* of the cylinder liner 11, as indicated by an arrow D2.

Although the water jacket spacer 32 of this embodiment is different from the second embodiment in the aspects mentioned above, it can achieve the same effects as the second embodiment.

Moreover, the water jacket spacer 32 of this embodiment is configured such that, when the contact member 321 takes the second posture, the longitudinal extending part 321*c* makes surface contact rather than a point contact with the outer wall surface 11*a* of the cylinder liner 11. Therefore, the heat generated in the bore upper part A1 of each of the cylinder bores 1*a* to 1*d* can effectively be transferred to the coolant via the cylinder liner 11 and the contact member 321. Thus, by adopting the water jacket spacer 32 of this embodiment, the contact member 321 makes wider surface contact with the outer wall surface 11*a* of the cylinder liner 11 in the second posture as compared to the contact members 121 and 221 in the first and second embodiments. As a result, the bore upper part A1 can be cooled more effectively during operation of the engine 3 (see FIG. 3).

Modification 1

Figure 7:
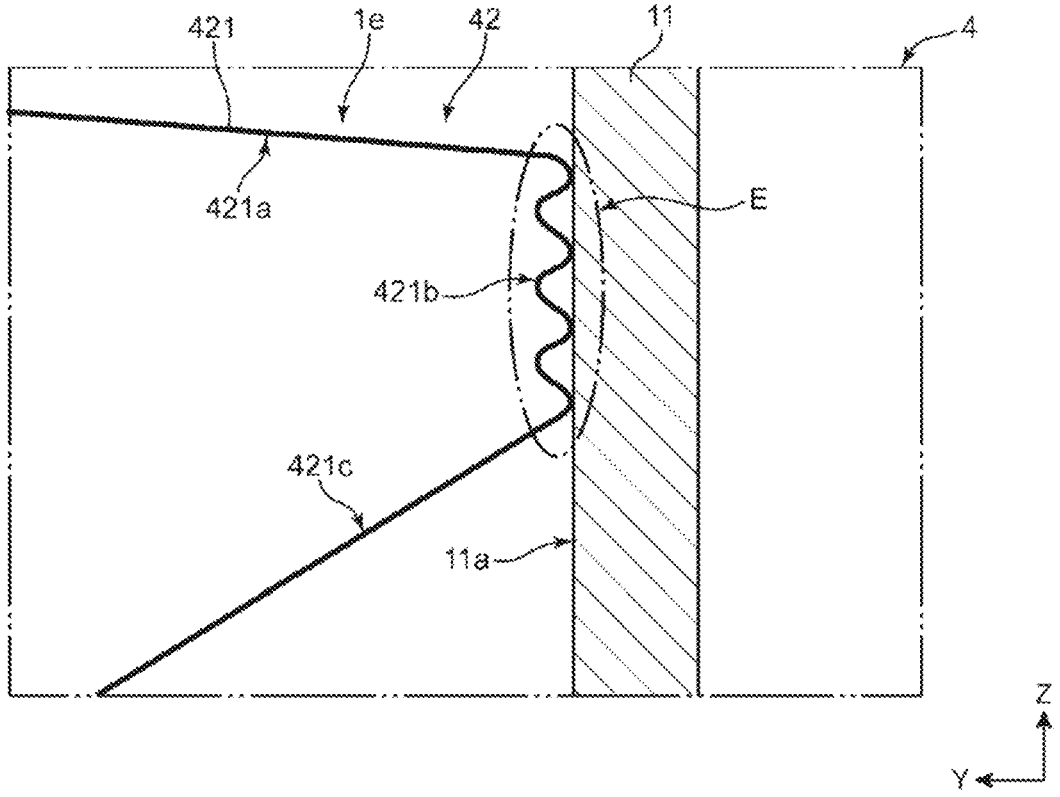
FIG. 7 is a cross-sectional view illustrating a partial structure of a water jacket spacer structure according to a first modification.

A structure of a water jacket spacer 42 according to Modification 1 will be explained with reference to FIG. 7. FIG. 7 is a cross-sectional view illustrating a partial structure of an engine 4 to which a water jacket spacer 42 is adopted. In FIG. 7, the same reference alphanumeric symbols are used for the same components as those in the first to third embodiments, and their explanations are omitted below.

The water jacket spacer 42 of this embodiment is different from the first to third embodiments in the shape of the contacting part with the cylinder liner 11 when a contact member 421 takes a second posture.

As illustrated in FIG. 7, the contact member 421 of this modification has a multi-curving part 421*b* connecting an upper extending part 421*a* with a lower extending part 321*c*. The multi-curving part 421*b* has multiple curving sections. When the contact member 421 takes the second posture, as indicated by an arrow E, multiple points of the multi-curving part 421*b* of the contact member 421 come into contact with the outer wall surface 11*a* of the cylinder liner 11.

The configuration of the contact member 421 of this modification can also be applied to the first and second embodiments. In this case, the same effects as the first and second embodiments can be obtained.

Furthermore, when the contact member 421 of this modification is adopted, the multi-curving part 421*b* makes multiple surface contacts with the outer wall surface 11*a* of the cylinder liner 11 rather than a single surface contact when the contact member 421 takes the second posture. Therefore, the heat generated in the bore upper part A1 of each of the cylinder bores 1*a* to 1*d* can effectively be transferred to coolant via the cylinder liner 11 and the contact member 421. Thus, by adopting the water jacket spacer 42 of this embodiment, the bore upper part A1 can be cooled more effectively during operation of the engine 4 (see FIG. 3).

In the cross-sectional view of FIG. 7, the contact between the contact member 421 and the outer wall surface 11*a* of the cylinder liner 11 when the contact member 421 takes the second posture is depicted as a point contact. However, in reality, the contact member 421 is configured to make surface contact, similarly to the first to third embodiments.

Fourth Embodiment

Figure 8:
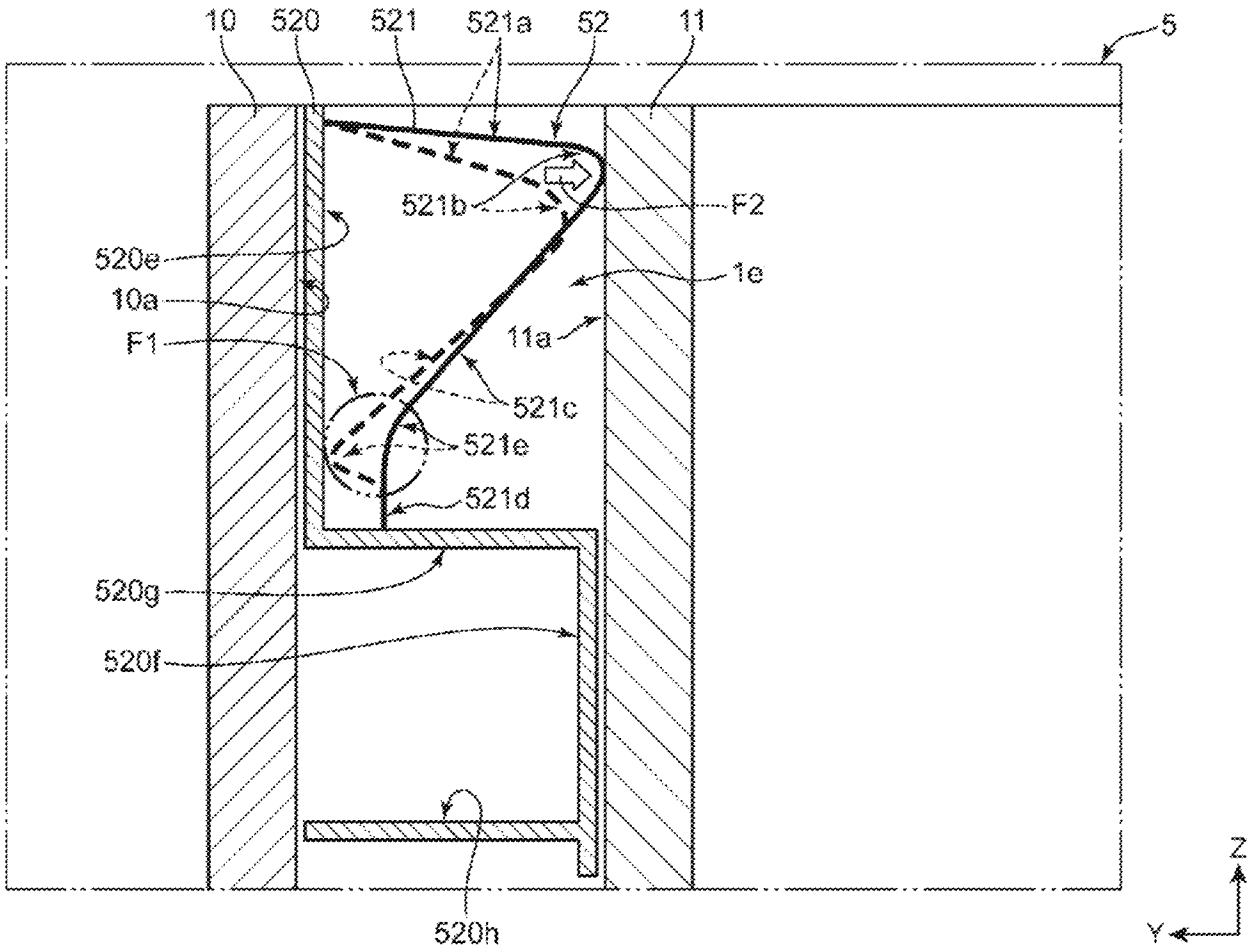
FIG. 8 is a cross-sectional view illustrating a structure of a water jacket spacer according to a fourth embodiment of the present disclosure.

A structure of a water jacket spacer 52 according to a fourth embodiment will be explained with reference to FIG. 8. FIG. 8 is a cross-sectional view illustrating a partial structure of an engine 5 to which the water jacket spacer 52 is adopted. In FIG. 8, the same reference alphanumeric symbols are used for the same components as those in the first to third embodiments, and their explanations are omitted below.

The water jacket spacer 52 of this embodiment is different from the first to third embodiments in that it is comprised of a spacer body member 520 and a contact member 521 and does not include an expandable member.

As illustrated in FIG. 8, also in the water jacket spacer 52 of this embodiment, the spacer body member 520 is formed by using a resin material, and is integrally formed with an upper wall part 520*e*, a lower wall part 520*f*, a connecting wall part 520*g*, and a bottom wall part 520*h*.

Similarly to the contact members 121, 221, 321, and 421 of the first to third embodiments and Modification 1, the contact member 521 of this embodiment is formed by using a metal material. However, while the contact members 121, 221, 321, and 421 of the first to third embodiments and Modification 1 are made from materials such as steel plate or copper alloy, the contact member 521 of this embodiment is formed by using shape-memory alloy.

Similarly to the contact member 121 of the first embodiment, the contact member 521 includes an upper extending part 521*a*, a curving part 521*b*, a lower extending part 521*c*, and a longitudinal extending part 521*d*. Further, the contact member 521 includes a curving part 521*e* connecting the lower extending part 521*c* with the longitudinal extending part 521*d*. The contact member 521 is integrally formed with the upper extending part 521*a*, the curving part 521*b*, the lower extending part 521*c*, the curving part 521*e*, and the longitudinal extending part 521*d*.

In the contact member 521, a lower end of the longitudinal extending part 521*d* (opposite from the side connected to the curving part 521*e*) is fixed to an upper surface of the connecting wall part 520*g* of the spacer body member 520.

In the engine 5 including the water jacket spacer 52 of this embodiment, after coolant is introduced into the water jacket 1*e*, when the engine 5 is operated and the coolant is below a given temperature (e.g., below 90° C.), the curving part 521*e* of the contact member 521 is curved at a large curvature (small radius of curvature), as indicated by the dashed line.

On the other hand, when the engine 5 is operated and the coolant temperature reaches the given temperature or above (e.g., 90° C. or higher), the curvature of the curving part 521*e* of the contact member 521 decreases (the radius of curvature increases), as indicated by the solid line (arrow F1). As a result, the contact member 521 changes its posture from a first posture (indicated by the dashed line) to a second posture (indicated by the solid line), and the curving part 521*b* is pressed against the outer wall surface 11*a* of the cylinder liner 11, as indicated by an arrow F2.

Although the water jacket spacer 52 of this embodiment is different from the first to third embodiments in that it does not include an expandable member, it can achieve the same effects as the first to third embodiments.

In the water jacket spacer 52 of this embodiment, since the contact member 521 is formed by using shape-memory alloy, the posture of the contact member 521 changes automatically based on the temperature of the coolant. That is, since the water jacket spacer 52 of this embodiment does not require an expandable member to change the posture of the contact member 521, the bore upper part A1 (see FIG. 3) can be cooled effectively during the engine operation with fewer components.

Note that the shape of the contact member 521 may be designed in a similar manner to any of the contact members in the third embodiment or Modification 1.

Furthermore, in the cross-sectional view of FIG. 8, the contact between the contact member 521 and the outer wall surface 11*a* of the cylinder liner 11 when the contact member 521 takes the second posture is depicted as a point contact. However, in reality, the contact member 521 is configured to make surface contact, similarly to the first to third embodiments and Modification 1.

Fifth Embodiment

Figure 9:
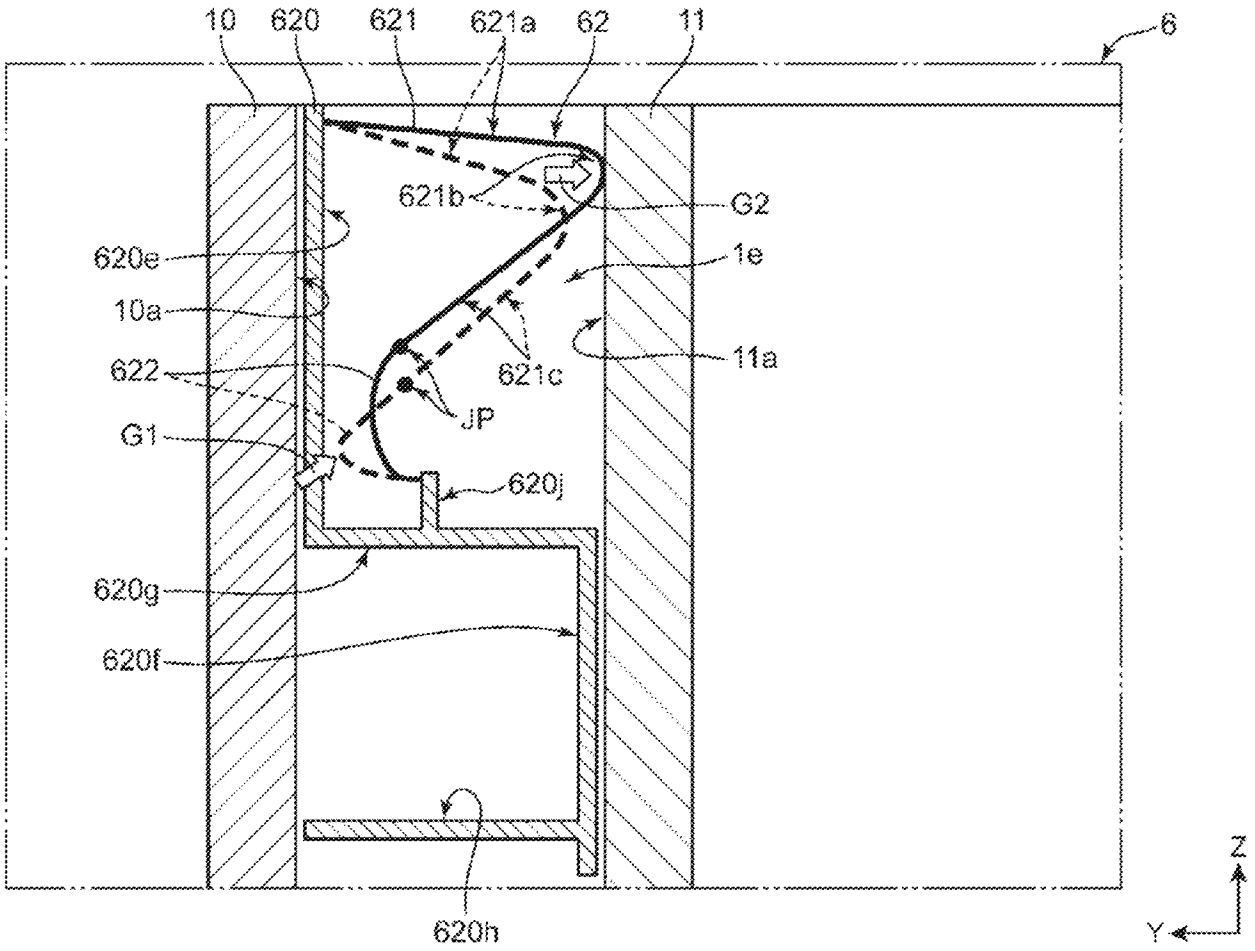
FIG. 9 is a cross-sectional view illustrating a structure of a water jacket spacer according to a fifth embodiment of the present disclosure.

A structure of a water jacket spacer 62 according to a fifth embodiment will be explained with reference to FIG. 9. FIG. 9 is a cross-sectional view illustrating a partial structure of an engine 6 to which the water jacket spacer 62 is adopted. In FIG. 9, the same reference alphanumeric symbols are used for the same components as those in the first to third embodiments, and their explanations are omitted below.

The water jacket spacer 62 of this embodiment is different from the second embodiment in that a bimetal component is used as an expandable member 622.

As illustrated in FIG. 9, also in the water jacket spacer 62 of this embodiment, a spacer body member 620 is formed by using a resin material, and is integrally formed with an upper wall part 620*e*, a lower wall part 620*f*, a connecting wall part 620*g*, and a bottom wall part 620*h*. Additionally, the spacer body member 620 has an anchor wall part 620*j* protruding upward from an upper surface of the connecting wall part 620*g*.

Similarly to the contact members 121, 221, 321, and 421 of the first to third embodiments and Modification 1, a contact member 621 is formed by using a metal material (e.g., steel plate or copper alloy).

Similarly to the contact member 221 of the second embodiment, the contact member 621 includes an upper extending part 621*a*, a curving part 621*b*, and a lower extending part 621*c*. Also here, the contact member 621 is integrally formed with the upper extending part 621*a*, the curving part 621*b*, and the lower extending part 621*c*.

An expandable member 622 of this embodiment is formed by using bimetal, either in plate or wire form. One end of the expandable member 622 is joined to one end of the lower extending part 621*c* of the contact member 621 (indicated by joining point JP), and the other end thereof is fixed to the anchor wall part 620*j* of the spacer body member 620.

In the engine 6 including the water jacket spacer 62 of this embodiment, when the engine 6 is operated and coolant flown into the water jacket 1*e* is below a given temperature (e.g., below 90° C.), the expandable member 622 is curved at a large curvature (small radius of curvature), as indicated by the dashed line.

On the other hand, when the engine 6 is operated and the coolant temperature reaches the given temperature or above (e.g., 90° C. or higher), the curvature of the expandable member 622 decreases (the radius of curvature increases), as indicated by the solid line pointed at by an arrow G1. As a result, the contact member 621 changes its posture from a first posture (indicated by the dashed line) to a second posture (indicated by the solid line), and the curving part 621*b* is pressed against the outer wall surface 11*a* of the cylinder liner 11, as indicated by an arrow G2.

Although the water jacket spacer 62 of this embodiment is different from the second embodiment in that it includes the expandable member 622, it can achieve the same effects as the second embodiment.

Moreover, in the water jacket spacer 62 of this embodiment, since the expandable member 622 is formed by using bimetal, compared to using cellulose sponge for the expandable member, resistance to the coolant flowing above the connecting wall part 620*g* can be reduced. In other words, in this embodiment where the expandable member 622 is formed by using bimetal, a projected surface area against the coolant flow in the water jacket 1*e* is reduced, thereby reducing resistance to the flow. Thus, by adopting the water jacket spacer 62 of this embodiment, the bore upper part A1 can effectively be cooled during the operation of the engine 6 (see FIG. 3).

Note that in this embodiment, although the expandable member 622 is disposed above the connecting wall part 620*g*, similarly to the first embodiment, it is also possible to dispose the expandable member 622 below the connecting wall part 620*g*.

Furthermore, also in the cross-sectional view of FIG. 9, the contact between the contact member 621 and the outer wall surface 11*a* of the cylinder liner 11 when the contact member 621 takes the second posture is depicted as a point contact. However, in reality, the contact member 621 is configured to make surface contact, similarly to the first to fourth embodiments and Modification 1.

Furthermore, the configuration of the contact member 621 can be similar to that of the contact member 321 in the third embodiment or the contact member 421 in Modification 1.

Modification 2

Figure 10A:
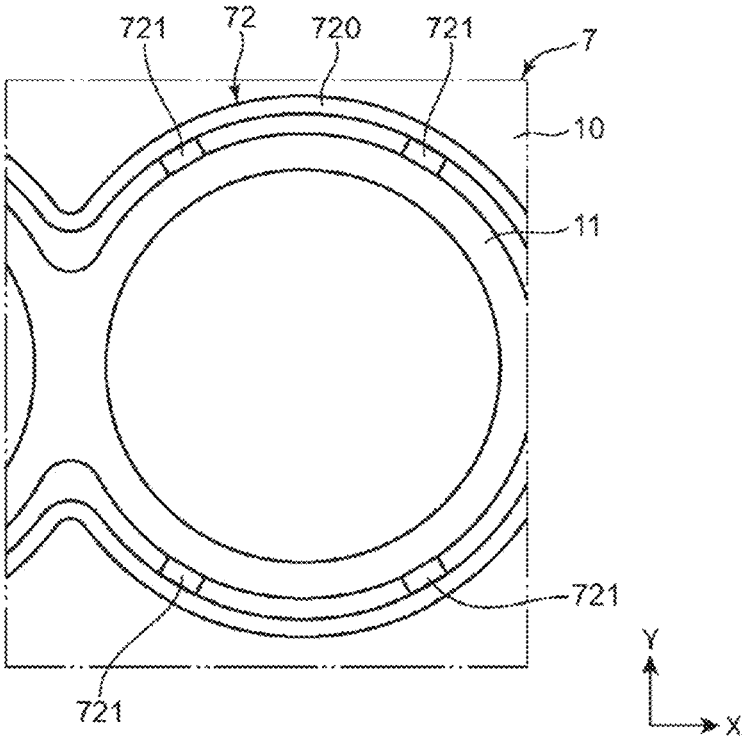
FIG. 10A is a plan view illustrating a partial structure of a water jacket spacer according to a second modification.

A structure of a water jacket spacer 72 according to Modification 2 will be explained with reference to FIG. 10A. FIG. 10A is a cross-sectional view illustrating a partial structure of an engine 7 to which the water jacket spacer 72 is adopted. In FIG. 10A, the same reference alphanumeric symbols are used for the same components as those in the first to fifth embodiments, and their explanations are omitted below.

The water jacket spacer 72 of this modification is different from the first to fifth embodiments and Modification 1 in that four contact members 721 are disposed in each cylinder bore.

Specifically, as illustrated in FIG. 10A, the water jacket spacer 72 of this modification has the four contact members 721 fixed to a spacer body member 720 having the same/similar structure as/to the spacer body member in any of the first to fifth embodiments and Modification 1. Each contact member 721 has the same/similar structure as those in any of the first to fifth embodiments or Modification 1.

The four contact members 721 arranged for each cylinder bore are arranged away from each other circumferentially. Note that the direction in which each contact member 721 changes its position from a first position to a second position relative to the cylinder liner 11 may be directed toward the center (cylinder axis) of the cylinder bore or slightly offset from the center. In this modification, the contact members 721 are formed by using a metal material (e.g., steel plate, copper alloy, or shape-memory alloy).

The water jacket spacer 72 of this modification is different from the first to fifth embodiments and Modification 1 in that it has the four contact members 721 arranged for each cylinder bore, and the other components are the same. Therefore, also when the water jacket spacer 72 of this modification is adopted, the same effects as in the first to fifth embodiments and Modification 1 can be obtained.

Furthermore, since the water jacket spacer 72 of this modification has the four contact members 721 for each cylinder bore, the heat generated in the bore upper part A1 (see FIG. 3) can effectively be transferred to coolant not only from the outer wall of the cylinder liner 11 but also through the contact members 721. As a result, the cooling of the bore upper part A1 (see FIG. 3) during operation of the engine 7 can be performed more effectively.

Note that although in this modification the four contact members 721 are arranged for each cylinder bore, it is also possible to arrange three contact members 721, or five or more contact members 721.

Modification 3

Figure 10B:
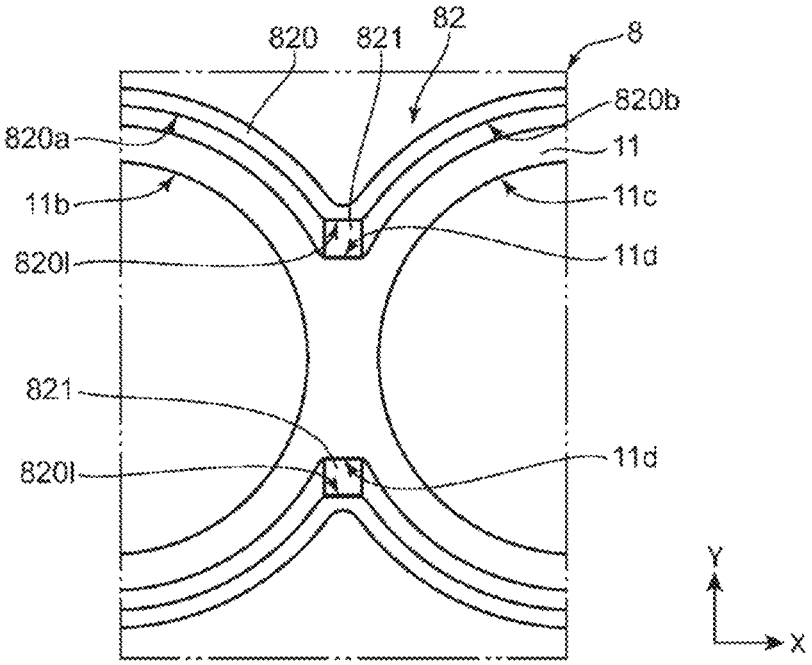
FIG. 10B is a plan view illustrating a partial structure of a water jacket spacer according to a third modification.

A structure of a water jacket spacer 82 according to Modification 3 will be explained with reference to FIG. 10B. FIG. 10B is a cross-sectional view illustrating a partial structure of an engine 8 to which the water jacket spacer 82 is adopted. In FIG. 10B, the same reference alphanumeric symbols are used for the same components as those in the first to fifth embodiments, and their explanations are omitted below.

The water jacket spacer 82 of this modification is different from the first to fifth embodiments and Modifications 1 and 2 in that a contact member 821 is arranged to be able to contact an inter-bore portion 11*d* of the cylinder liner 11 between adjacent cylinder bores.

Specifically, as illustrated in FIG. 10B, the cylinder liner 11 has bore circumferential portions 11*b* and 11*c* surrounding the cylinder bores, and the inter-bore portion 11*d* formed between the adjacent bore circumferential portions 11*b* and 11*c* in the X direction (cylinder row direction). The inter-bore portion 11*d* is recessed inward in the Y direction (intake-and-exhaust direction) as compared to the bore circumferential portions 11*b* and 11*c*.

During operation of the engine 8, a temperature of the inter-bore portion 11*d* rises as compared to the bore circumferential portions 11*b* and 11*c*.

The water jacket spacer 82 of this modification has the contact member 821 fixed to an inter-bore portion 8201 of a spacer body member 820. The inter-bore portion 8201 of the spacer body member 820 faces the inter-bore portion 11*d* of the cylinder liner 11 in the Y direction, and is located between bore circumferential portions 820*a* and 820*b* surrounding the bore circumferential portions 11*b* and 11*c* of the cylinder liner 11, respectively.

Note that, also in this modification, the contact member 821 is formed by using a metal material (e.g., steel plate, copper alloy, or shape-memory alloy) and has higher thermal conductivity than the resin material constituting the spacer body member 820 or the cylinder liner 11.

The water jacket spacer 82 of this modification is different from the first to fifth embodiments and Modifications 1 and 2 in the arrangement of the contact member 821 relative to the cylinder liner 11, but the other components are the same. Therefore, also when the water jacket spacer 82 of this modification is adopted, the same effects as in the first to fifth embodiments and Modifications 1 and 2 can be obtained.

Moreover, in the water jacket spacer 82 of this modification, since the contact member 821 is fixed to the inter-bore portion 8201 of the spacer body member 820 and contacts the inter-bore portion 11*d* of the cylinder liner 11 during the operation of the engine 8, the heat generated in the inter-bore portion 11*d* which has a high temperature during the operation of the engine 8 can be transferred to coolant through the contact member 821. Therefore, the bore upper part A1 can be cooled more effectively during the operation of the engine 8 (see FIG. 3).

Note that the arrangement of the contact member 821 of this modification may be combined with the arrangement in any of the first to fifth embodiments and Modifications 1 and 2.

Furthermore, the structure of the contact member 821 may be the same as or similar to that in any of the first to fifth embodiments or Modifications 1 and 2, or any combination thereof may also be adopted.

Modification 4

Figure 11A:
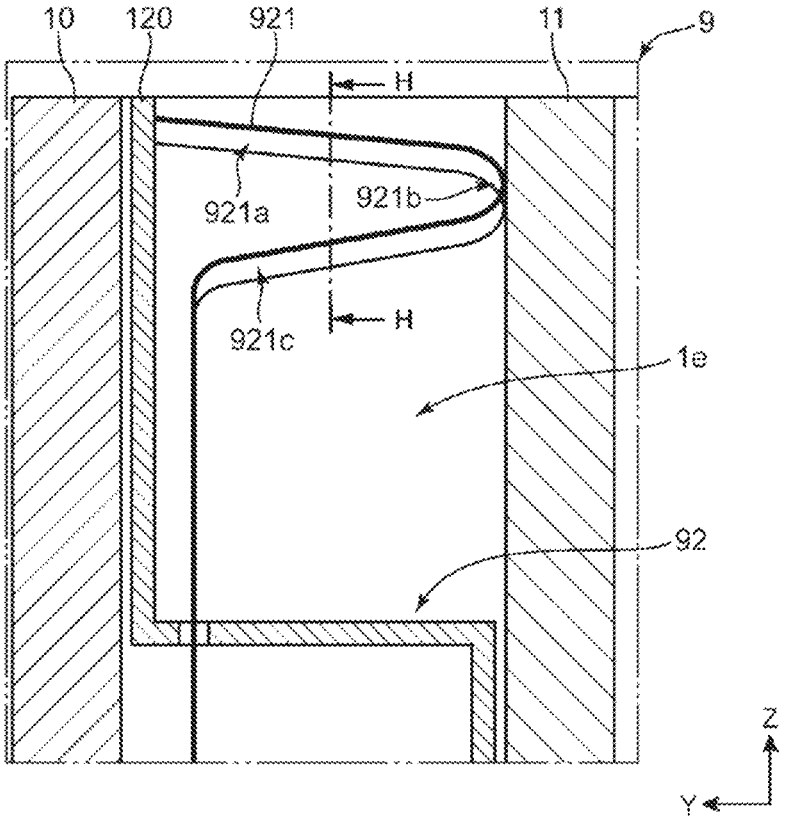
FIG. 11A is a cross-sectional view illustrating a structure of a water jacket spacer according to a fourth modification.
Figure 11B:
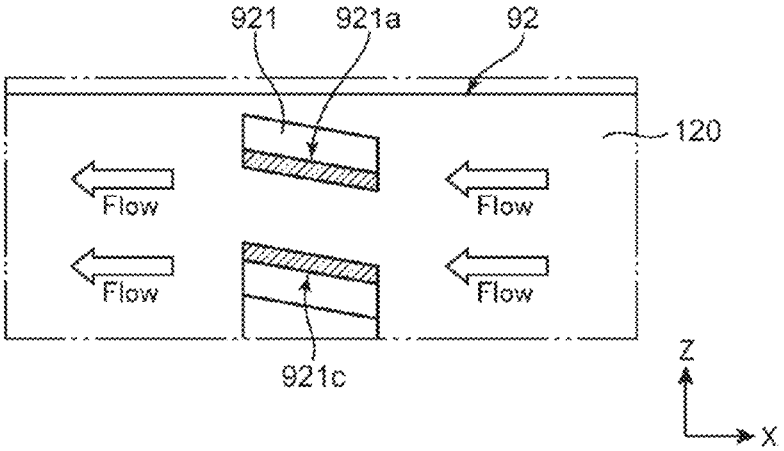
FIG. 11B is a cross-sectional view illustrating a cross-sectional structure of the water jacket spacer in the H-H cross-sectional line of FIG. 11A.

A structure of a water jacket spacer 92 according to Modification 4 will be explained with reference to FIGS. 11A and 11B. FIG. 11A is a cross-sectional view illustrating a partial structure of an engine 9 to which the water jacket spacer 92 is adopted. FIG. 11B is a cross-sectional view taken by the line H-H of FIG. 11A. In FIGS. 11A and 11B, the same reference alphanumeric symbols are used for the same components as those in the first to fifth embodiments, and their explanations are omitted below.

The water jacket spacer 92 according to this embodiment is different from the first to fifth embodiments and Modifications 1 to 3 in that an upper extending part 921*a* and a lower extending part 921*c* of a contact member 921 are arranged diagonally relative to the direction of a coolant flow inside the water jacket 1*e*.

Specifically, as illustrated in FIG. 11A, the contact member 921 of the water jacket spacer 92 has the upper extending part 921*a*, a curving part 921*b*, and the lower extending part 921*c*, similarly to the first embodiment. As illustrated in FIGS. 11A and 11B, in this modification, surface angles of the upper extending part 921*a* and the lower extending part 921*c* are formed to be diagonal relative to the direction of the coolant flow (Flow).

The contact member 921 of this modification is also formed by using a metal material (e.g., steel plates, copper alloys, or shape-memory alloy), similarly to the first to fifth embodiments and Modifications 1 to 3.

The water jacket spacer 92 of this modification is different from the first to fifth embodiments and Modifications 1 to 3 in that the upper and lower extending parts 921*a* and 921*c* of the contact member 921 are arranged diagonally to the direction of the coolant flow (Flow), and other components are the same. Therefore, also when the water jacket spacer 92 of this modification is adopted, the same effects as those in the first to fifth embodiments and Modifications 1 to 3 can be obtained.

Further, in the water jacket spacer 92 of this modification, since the upper and lower extending parts 921*a* and 921*c* of the contact member 921 are arranged diagonally to the direction of the coolant flow (Flow), the surface area which comes into contact with the coolant flow becomes larger, improving the heat release effect. Therefore, by adopting the water jacket spacer 92 of this modification, the bore upper part A1 can be cooled more effectively during operation of the engine 9 (see FIG. 3).

Furthermore, in a case where the contact member 921 of this modification is formed by using shape-memory alloy, the contact member 921 may be configured such that the angles of the upper and lower extending parts 921*a* and 921*c* change only when a temperature of the coolant reaches a given temperature or above, as illustrated in FIGS. 11A and 11B.

Additionally, the structure of the contact member 921 of this modification may be combined with the structure of any of the second to fifth embodiments and Modifications 1 to 3.

Other Modifications

In the first to fifth embodiments and Modifications 1 to 4, the spacer body members 120, 220, 320, 520, 620, 720, and 820 are integrally formed by using resin materials. However, in the present disclosure, a spacer body member comprised of multiple elements may also be adopted.

In the first to fifth embodiments and Modifications 1 to 4, the contact members 121, 221, 321, 421, 521, 621, 721, 821, and 921 are integrally formed by using metal materials. However, in the present disclosure, a contact member comprised of multiple elements may also be adopted. For example, the contact member may be formed using a thicker metal plate in part(s) which is not desired to deform during the posture change from the first to second posture, while the rigidity of part(s) which is pressed against the cylinder bore wall in the second posture may be reduced to increase the contact surface area.

In the first to fifth embodiments and Modifications 1 to 4, the water jacket spacers 12, 22, 32, 42, 52, 62, 72, 82, and 92 are applied to the inline four-cylinder engines 1 to 9. However, the present disclosure may be applied to engines with a single cylinder, two cylinders, three cylinders, and even five or more cylinders. Additionally, engine types such as V-type or W-type engines having four or more cylinders may also be adopted.

In the first to fifth embodiments and Modifications 1 to 4, the structure in which the cylinder liner 11 is fitted into the cylinder block 10 is adopted. However, the present disclosure is not limited to this. An engine may be adopted in which the cylinder bore wall is directly formed in the cylinder block.

In the first to fifth embodiments and Modifications 1 to 4, the spacer body members 120, 220, 320, 520, 620, 720, and 820 are formed by using resin materials, and the contact members 121, 221, 321, 421, 521, 621, 721, 821, and 921 are formed by using metal materials. However, the present disclosure is not limited to this. As long as the contact member has higher thermal conductivity than the spacer body member and the cylinder liner 11, any material may be used for each component. For example, the contact member and the spacer body member may both be formed by using resin materials or metal materials.

Furthermore, when a spacer body member formed by using ceramics is adopted, the spacer body member has high thermal conductivity depending to the selection of material, which is advantageous for cooling the engine.

In the first to fifth embodiments and Modifications 1 to 4, the contact members 121, 221, 321, 421, 521, 621, 721, 821, and 921 are arranged on both the intake and exhaust sides in the outer periphery of the cylinder liner 11. However, the present disclosure is not limited to this. For example, it may be such that the contact members are only arranged on the exhaust side in the outer periphery of the cylinder liner (cylinder bore wall) 11. Since the bore upper part reaches a higher temperature on the exhaust side than on the intake side during the engine operation, also by arranging the contact members only on the exhaust side, where the temperature is higher, the bore upper part can effectively be cooled.

Moreover, in the first to fifth embodiments and Modifications 1 to 4, the metal material, such as steel plate, is used to form the contact members 121, 221, 321, 421, 521, 621, 721, 821, and 921. Among metal materials, copper alloy has higher thermal conductivity than the respective materials constituting the cylinder bore wall and the cylinder block and, thus, is particularly suitable for transferring the heat of the bore upper part to the coolant.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1-9 Engine
1*e* Water Jacket
10 Cylinder Block
10*a* Inner Wall Surface
11 Cylinder Liner (Cylinder Bore Wall)
11*a* Outer Wall Surface
12, 22, 32, 42, 52, 62, 92 Water Jacket Spacer
120, 220, 320, 520, 620, 720, 820 Spacer Body Member
120*e*, 220*e*, 320*e*, 520*e*, 620*e* Upper Wall Part
120*f*, 220*f*, 320*f*, 520*f*, 620*f* Lower Wall Part
121, 221, 321, 421, 521, 621, 721, 821, 921 Contact Member
122, 222, 322, 622 Expandable Member
A1 Bore Upper Part
A2 Bore Lower Part

What is claimed is:

1. A structure of a water jacket spacer that is inserted into a water jacket formed between an outer wall surface of a wall of a cylinder bore of an engine and an inner wall surface of a cylinder block, the engine having a top dead center side of the cylinder bore as an upper side and a bottom dead center thereof as a lower side, the structure comprising:

a spacer body member including an upper wall part in an upper part of the water jacket and a lower wall part in a lower part of the water jacket, the upper wall part relatively closer to the inner wall surface and the lower wall part relatively closer to the outer wall surface; and an elongated contact member fixed at one end to the upper wall part of the spacer body member, changeable between a first posture separated from the outer wall surface and a second posture contacting the outer wall surface, and having a higher heat conductivity than the spacer body member and the wall of the cylinder bore, wherein the contact member is in the first posture in a state where coolant is not filled in the water jacket and the engine is not operated, and is in the second posture in a state where the coolant is filled in the water jacket and the engine is operated.

2. The structure of the water jacket spacer of claim 1, further comprising an expandable member changeable between a state where the expandable member is contracted to bring the contact member into the first posture, and a state where the expandable member is extended to bring the contact member into the second posture.

3. The structure of the water jacket spacer of claim 2, wherein the expandable member is formed using one of cellulose sponge and bimetal.

4. The structure of the water jacket spacer of claim 3, wherein the spacer body member includes a connecting wall part connecting the upper wall part with the lower wall part, wherein the connecting wall part is formed with a through hole through which the contact member is inserted, and wherein the expandable member is disposed below the connecting wall part.

5. The structure of the water jacket spacer of claim 3, wherein the spacer body member includes a connecting wall part connecting the upper wall part with the lower wall part, and wherein the expandable member is disposed on or above the connecting wall part.

6. The structure of the water jacket spacer of claim 3, wherein the spacer body member is formed using a resin material, and wherein the contact member is formed using a metal material.

7. The structure of the water jacket spacer of claim 3, wherein the contact member is formed using shape-memory alloy, and configured to be in the first posture when a temperature of the contact member is below a given temperature, and the second posture when the temperature of the contact member is the given temperature or above in association with a temperature rise of the coolant.

8. The structure of the water jacket spacer of claim 2, wherein the spacer body member includes a connecting wall part connecting the upper wall part with the lower wall part, wherein the connecting wall part is formed with a through hole through which the contact member is inserted, and wherein the expandable member is disposed below the connecting wall part.

9. The structure of the water jacket spacer of claim 8, wherein the spacer body member includes a connecting wall part connecting the upper wall part with the lower wall part, and wherein the expandable member is disposed on or above the connecting wall part.

10. The structure of the water jacket spacer of claim 8, wherein the spacer body member is formed using a resin material, and wherein the contact member is formed using a metal material.

11. The structure of the water jacket spacer of claim 2, wherein the spacer body member includes a connecting wall part connecting the upper wall part with the lower wall part, and wherein the expandable member is disposed on or above the connecting wall part.

12. The structure of the water jacket spacer of claim 11, wherein the spacer body member is formed using a resin material, and wherein the contact member is formed using a metal material.

13. The structure of the water jacket spacer of claim 2, wherein the spacer body member is formed using a resin material, and wherein the contact member is formed using a metal material.

14. The structure of the water jacket spacer of claim 13, wherein the contact member changes between the first posture and the second posture within an elastic range.

15. The structure of the water jacket spacer of claim 2, wherein the contact member is formed using a shape-memory alloy, and configured to be in the first posture when a temperature of the contact member is below a given temperature, and the second posture when the temperature of the contact member is the given temperature or above in association with a temperature rise of the coolant.

16. The structure of the water jacket spacer of claim 2, wherein the contact member is one of a plurality of contact members arranged in a wall of a single cylinder bore to be away from each other in a circumferential direction of the cylinder bore.

17. The structure of the water jacket spacer of claim 2, wherein the engine is an inline multi-cylinder engine formed with a plurality of cylinder bores arranged in a cylinder-row direction, and wherein the contact member is disposed to be contactable in a part of the outer wall surface of the cylinder bore wall between adjacent cylinder bores.

18. The structure of the water jacket spacer of claim 1, wherein the contact member is formed using a shape-memory alloy, and configured to be in the first posture when a temperature of the contact member is below a given temperature, and the second posture when the temperature of the contact member is the given temperature or above in association with a temperature rise of the coolant.

19. The structure of the water jacket spacer of claim 1, wherein the contact member is one of a plurality of contact members arranged in a wall of a single cylinder bore to be away from each other in a circumferential direction of the cylinder bore.

20. The structure of the water jacket spacer of claim 1, wherein the engine is an inline multi-cylinder engine formed with a plurality of cylinder bores arranged in a cylinder-row direction, and wherein the contact member is disposed to be contactable in a part of the outer wall surface of the cylinder bore wall between adjacent cylinder bores.

* * * * *